US007461672B2

(12) United States Patent
Lockhart, Jr.

(10) Patent No.: US 7,461,672 B2
(45) Date of Patent: Dec. 9, 2008

(54) SYSTEMS AND METHODS FOR FACILITATING LOADING OF BAGS

(76) Inventor: Daniel Elvin Lockhart, Jr., 210 Teague St., Borger, TX (US) 79007

( * ) Notice: Subject to any disclaimer, the term of this patent is extended or adjusted under 35 U.S.C. 154(b) by 270 days.

(21) Appl. No.: 11/222,659

(22) Filed: Sep. 9, 2005

(65) Prior Publication Data

US 2007/0074781 A1 Apr. 5, 2007

(51) Int. Cl.
*B65B 1/04* (2006.01)

(52) U.S. Cl. ..... 141/313; 141/10; 141/67; 141/256

(58) Field of Classification Search ..... 141/2, 141/10, 114, 129, 256, 313; 53/469, 558, 53/254

See application file for complete search history.

(56) References Cited

U.S. PATENT DOCUMENTS

| | | | | |
|---|---|---|---|---|
| 2,974,467 | A * | 3/1961 | Long | 56/128 |
| 3,827,642 | A * | 8/1974 | Sageman | 241/101.742 |
| 3,842,569 | A * | 10/1974 | McClelland et al. | 53/469 |
| 4,395,867 | A * | 8/1983 | Cooper et al. | 56/327.1 |
| 5,199,666 | A * | 4/1993 | Williams | 241/73 |
| 6,840,877 | B2 * | 1/2005 | Sakundiak | 474/87 |

* cited by examiner

*Primary Examiner*—Timothy L Maust
(74) *Attorney, Agent, or Firm*—Patrick Stellitano, P.C.

(57) ABSTRACT

Systems, methods and media for faster filling of bags with material are disclosed. An accelerating mechanism accelerates material flowing through a chute from a material supply to a bag of a bag supplier.

17 Claims, 6 Drawing Sheets

SYSTEMS AND METHODS FOR FACILITATING LOADING OF BAGS

FIELD

The present invention is in the field of filling bags. More particularly, the invention is in the field of improvement in the speed of filling bags with bulk material such as mulch, bark, feed, etc.

BACKGROUND

Many industries manufacture and sell bulk material in bags. These industries include those that provide bagged mulch, potting soil, bark, fertilizer, animal feed and grain, cement mix, and the like. The industries employ sophisticated equipment to automate the process of filling bags with materials. For example, an automated bagging line will include a bagger or doser to provide a dose of material to be dumped into a bag. A form, fill, and seal machine will provide, in succession, a plurality of bags to be filled. FIG. 1A shows a block diagram of the process. A source of material 150 is provided to a conveyor belt 152. The conveyor belt may be level or inclined. A leveler 154 levels the height of the material as it progresses to the end of conveyor belt 152. When the material reaches the end of the conveyor, the material falls into a bag provided by a form, fill, and seal machine. The form, fill and seal machine comprises a source of plastic material in the form of a roll 160. A bag forming mechanism 162 receives plastic material from roll 160 and forms a bag and places it in a position with the bag open 164 to receive material from conveyor 152. The bag is then moved and sealed 166.

SUMMARY

The problems of the prior art are in large part addressed by an apparatus and method for filling bags faster. One embodiment comprises a material accelerator placed between a material supplier and a bag supplier to accelerate the material that flows from the material supplier to a bag supplied by the bag supplier. Another embodiment threshes and accelerates the material.

BRIEF DESCRIPTION OF THE DRAWINGS

Advantages of the invention will become apparent upon reading the following detailed description and upon reference to the accompanying drawings in which, like references may indicate similar elements.

DETAILED DESCRIPTION OF EMBODIMENTS

The following is a detailed description of example embodiments of the invention depicted in the accompanying drawings. The example embodiments are in such detail as to clearly communicate the invention. However, the amount of detail offered is not intended to limit the anticipated variations of embodiments; but, on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

Systems, methods and media for bagging products such as dirt, mulch, fertilizer, cat litter, salt, feed, grain, cement, and other bulk material are disclosed. A bulk material accelerator couples a machine for delivering bulk material to a machine that provides bags to receive the material. The accelerator has a chute that provides a path of flow of bulk material between the machine that delivers the bulk material and the machine that produces the bag to hold the material. In an embodiment, cylindrical rollers partially protrude into the path of the material to accelerate the flow of bulk material through the chute. The rollers may contain projections that project into and tear at the bulk material to prevent the material from clogging the chute and to facilitate acceleration of the bulk material through the chute. Embodiments enable acceleration of the step of filling a bag so that the bag form, fill and seal machine will be able to operate at its highest speed.

Figure 1A:
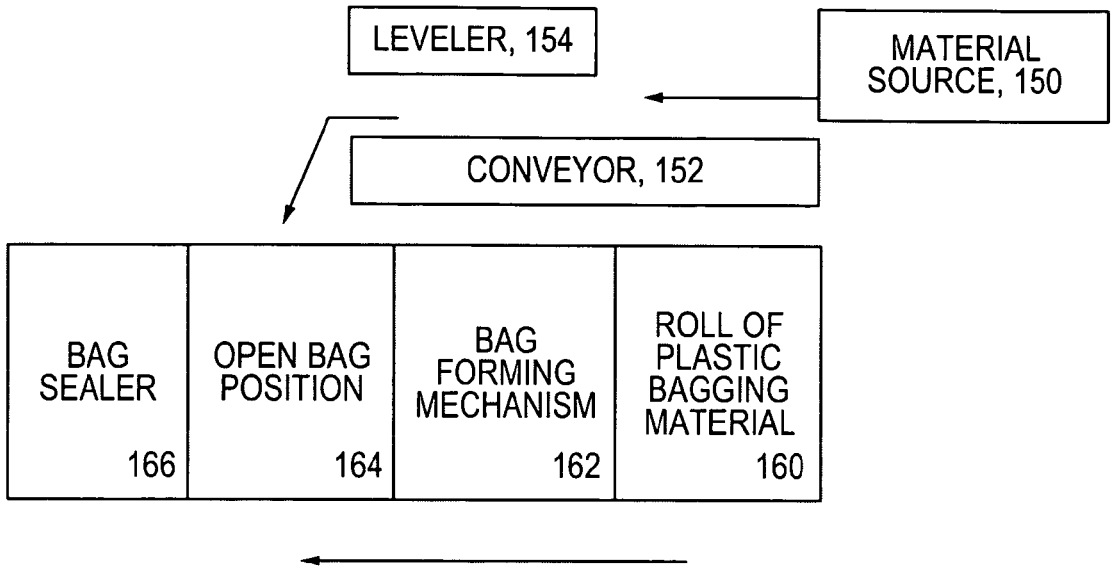
FIG. 1A (Prior Art)
FIG. 1A depicts a block diagram of a bagging line process.
Figure 1:
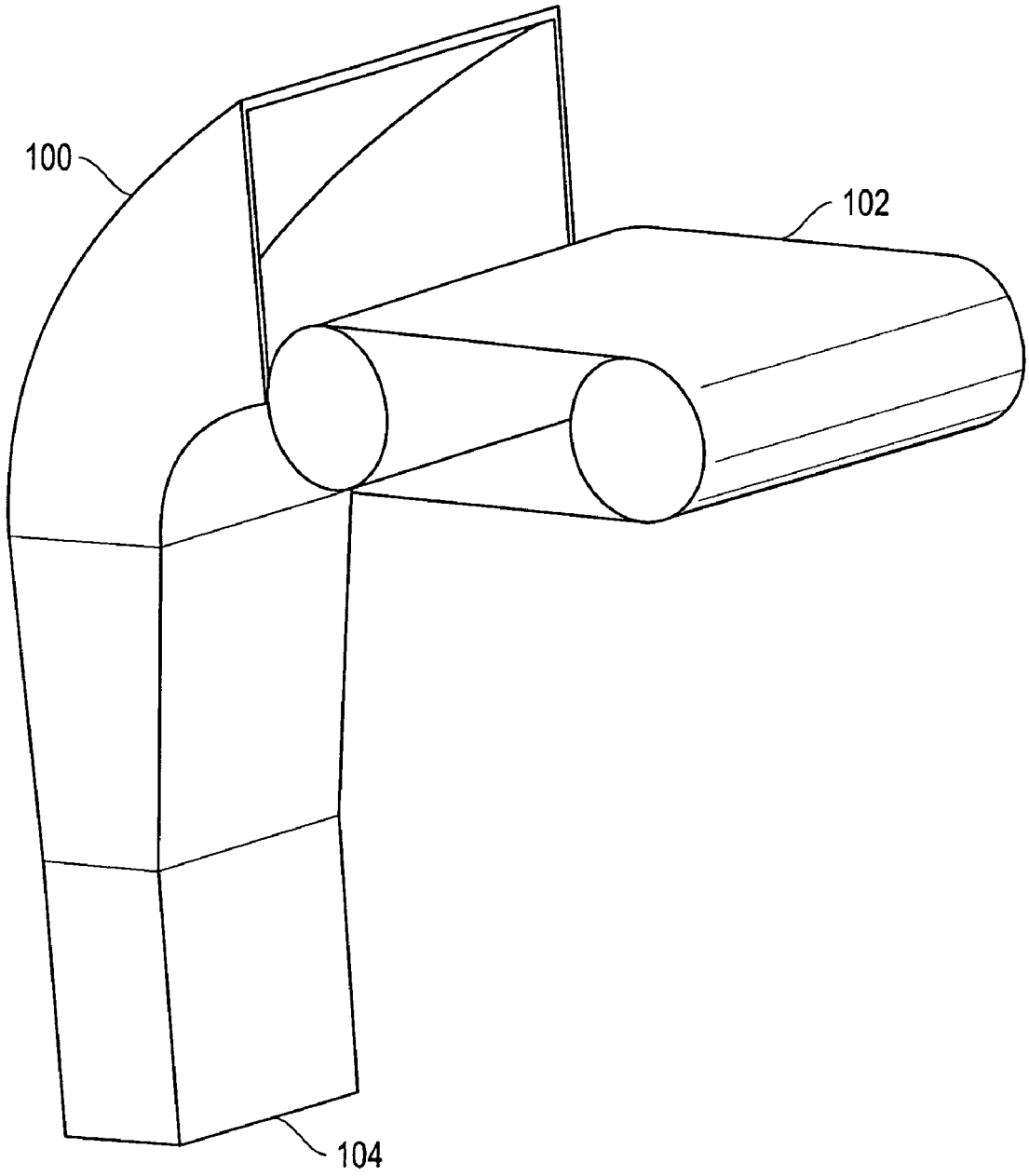
FIG. 1 depicts an embodiment of a funneling chute.

FIG. 1 shows a chute 100 for guiding bulk material from a conveyor belt 102 of a material supply machine to a bag of a form, fill and seal packaging system. For clarity, FIG. 1 shows the chute without the accelerating mechanisms employed to accelerate the material through the chute. An example of a bagger or material doser is the Southtech Industries, Inc., Model AP-2000 Open Mouth Bagger. (See website at www southtechind com). Conveyor belt 102 delivers bulk material to chute 100 at a specifiable rate of cubic yards per minute. At the bottom 104 of chute 100 is disposed a bag to receive bulk material that passes through chute 100. A plurality of bags may be consecutively presented to bottom 104 of chute 100 by a form, fill and seal packaging machine such as the Hamer Model 2080 (See website at www hamerinc com). The arc of chute 100 is designed to track the trajectory of material from conveyor belt 102 of the bagger. Note also that the chute is funneled to match a first cross section through which material is received from the doser, and to match a second, smaller cross section through which the material is delivered to the bag.

Figure 2:
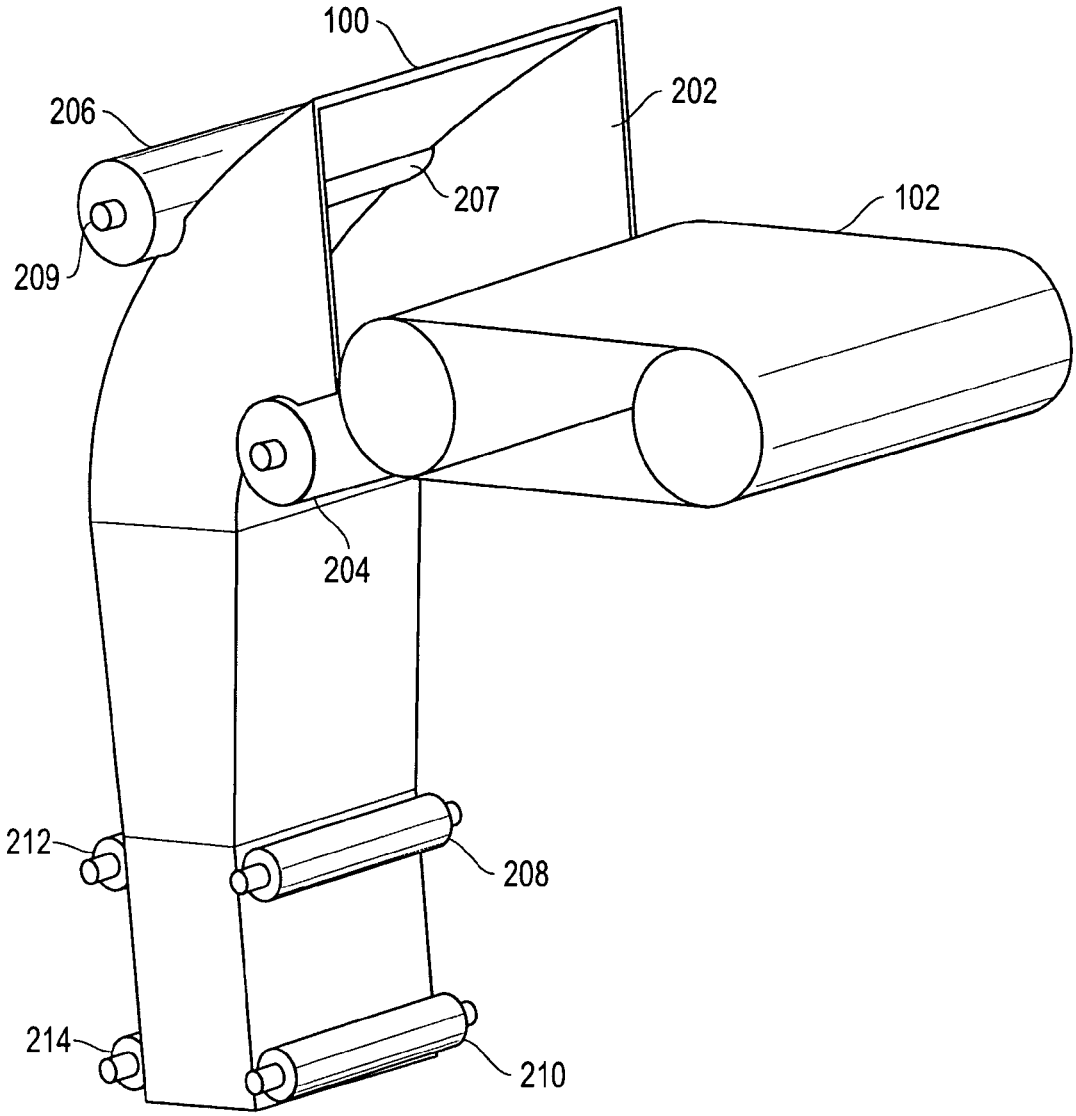
FIG. 2 depicts an embodiment of a funneling chute with accelerating rollers.

FIG. 2 shows an embodiment of chute 100 joined with accelerator mechanisms to accelerate the bulk material passing through chute 100. As before, conveyor belt 102 delivers bulk material through opening 202 of chute 100. A set of rollers 204 and 206, disposed near opening 202, accelerate the material entering chute 100. A roller 204 or 206 is a cylindrical shaped object and an arcuate surface 207 of the cylinder protrudes through an opening in chute 100 made there for. Thus, in one embodiment, an arcuate surface of a cylinder 204, 206 penetrates into the interior to make contact with the bulk material therein. A cylindrical roller comprises a shaft 209. A drive mechanism such as a rotary motor drives the shaft and roller to rotate about the shaft axis.

As shaft 209 rotates, arcuate surface 207 of roller 206 comes in contact with bulk material inside chute 100 and imparts velocity to the bulk material coming in contact there with. The velocity imparted to the bulk material may be higher than the velocity at which the material enters chute 100. Thus, roller surfaces 207 may impart acceleration to the bulk material. FIG. 2 also shows additional rollers 208, 210, 212 and 214. Each roller may impart acceleration to bulk material passing through the chute. The propelling of bulk material through the chute at a faster rate, as provided by the rollers, enables the bagger which supplies the material to operate at a faster speed, thereby providing more material to the chute per unit of time. Also, due to the acceleration imparted to the material within the chute, bags are filled more quickly. This enables the form, fill and seal machine to operate at its highest speed.

Figure 3:
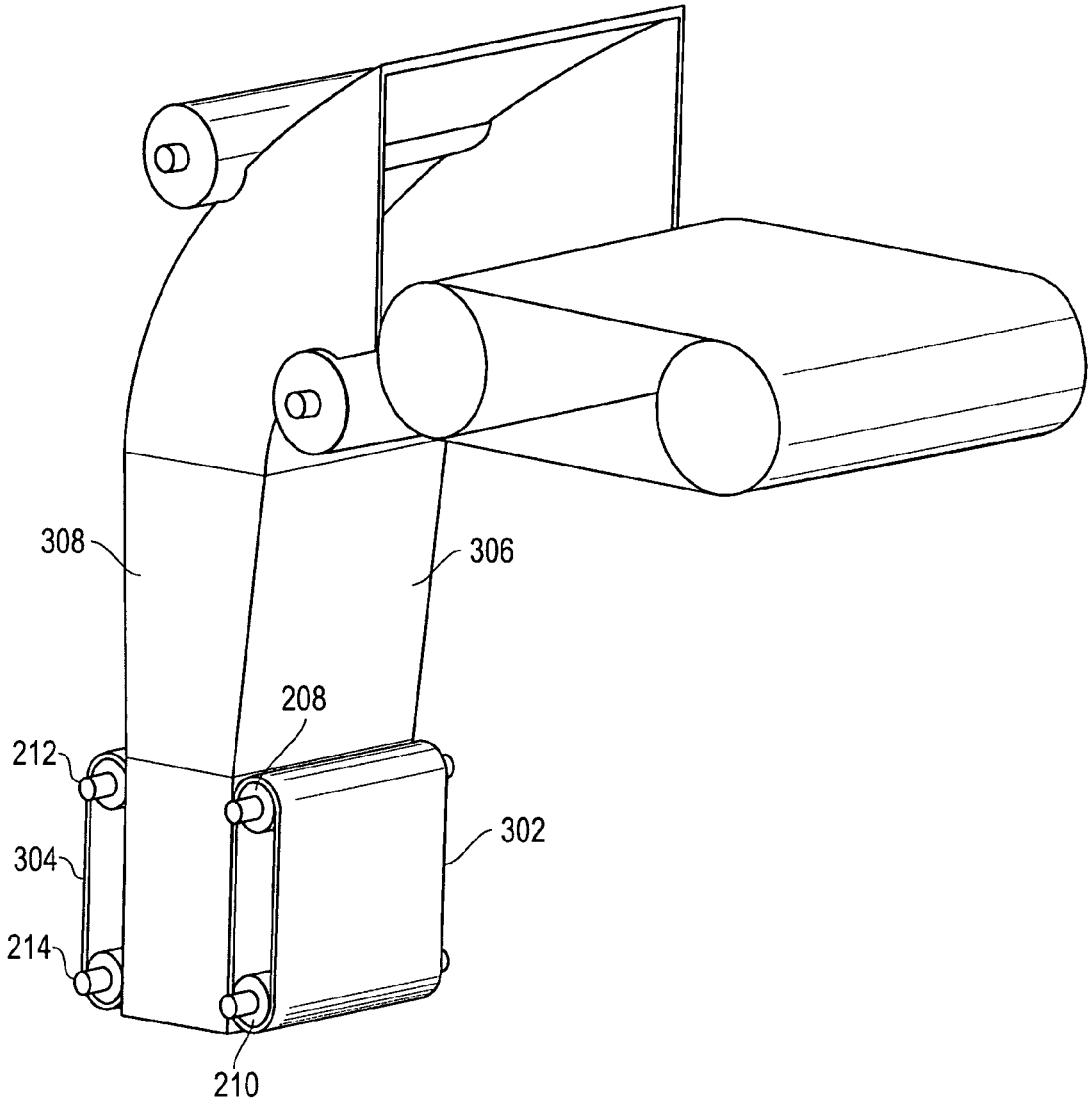
FIG. 3 depicts an embodiment of a funneling chute, rollers and conveyor belts.

FIG. 3 shows a variation of the embodiment of FIG. 2 with conveyor belts 302 and 304. Conveyor belt 302 is pulled by cylinders 208 and 210. Conveyor belt 304 is pulled by cylinders 212 and 214. In some embodiments, conveyor belts 302 and 304 do not exhibit a smooth surface. Rather, conveyor belts 302 and 304 may exhibit a course surface or be cleated or chevroned. For example protrusions emanating from the surface of the belt may cut into and accelerate the bulk material passing through chute 100. Variations rendered obvious by the description of embodiments include additional rollers in the center region 306 of chute 100 and/or on the sides 308 of chute 100.

Figure 4:
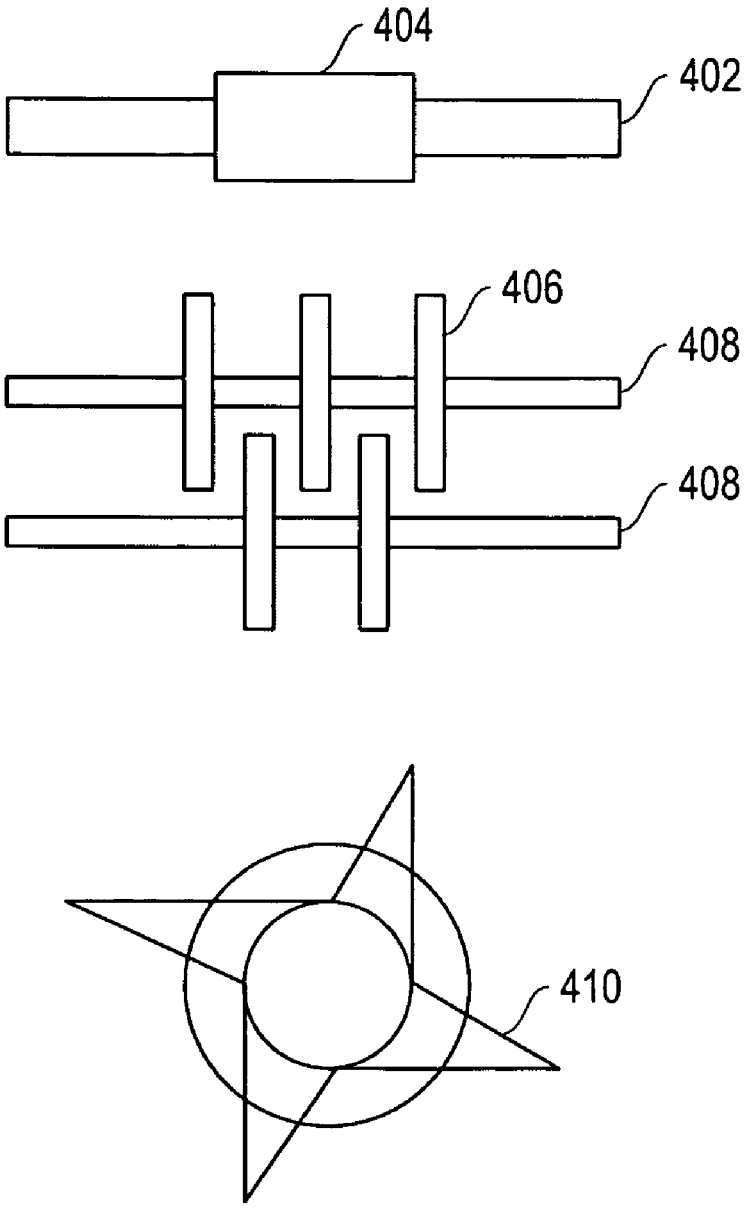
FIG. 4 depicts embodiments of threshing and accelerating mechanisms.

FIG. 4 shows variations of cylindrical accelerating mechanisms that may be used to form rollers such as shown in FIGS. 2 and 3. In one embodiment, a roller 404 is mounted on a shaft 402. In another embodiment, interleaving discs 406 are mounted on shafts 408. In this embodiment, the interleaving discs serve to accelerate and thresh the material flowing through the chute. In yet another embodiment, one or more star-shaped devices 410 are mounted to a shaft. The blades of star 410 cut into and chop and thresh the material flowing through chute 100. Thus, embodiments may not only accelerate the material flowing through chute 100, but also thresh the material to prevent clogging and enable rapid material flow. Clearly, a combination of rollers, discs, stars, etc., can be used to form acceleration and threshing mechanisms.

Figure 5:
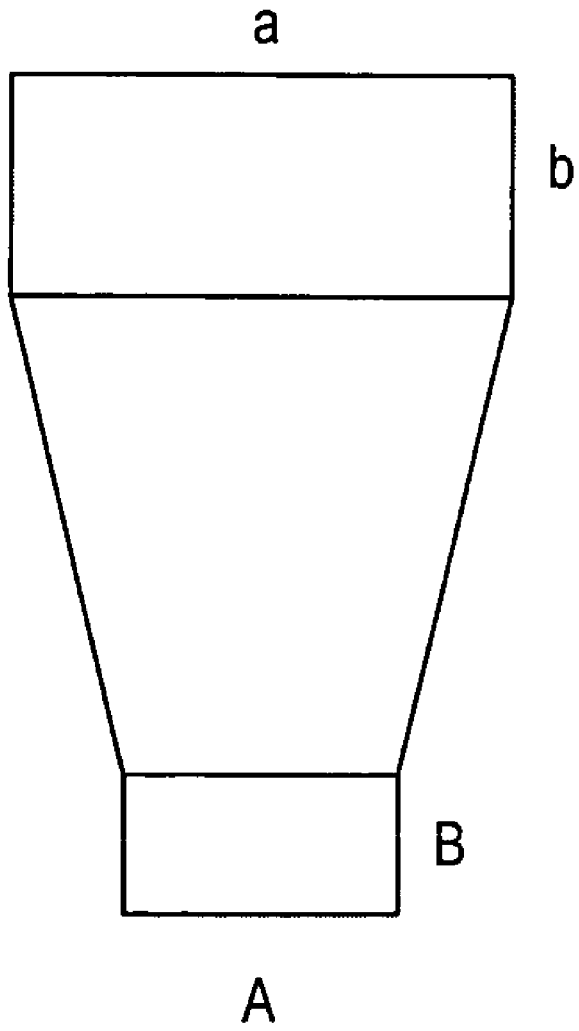
FIG. 5 depicts a graphical illustration of funneling and accelerating of material.

FIG. 5 shows a graphical illustration of an embodiment of a process for accelerating material to achieve faster bagging. Material from a conveyor of the material supplying machine has an exit opening of dimension a×b. At the exit of the accelerating process is an opening of dimension A×B. Optimally, the rate of material passing through the rectangle ab is the same as the rate of material passing through the rectangle AB. Thus, the velocity should increase by a factor ab/AB. This amount of acceleration can be imparted to the material by the mechanisms described herein.

Although the present invention and some of its advantages have been described in detail for some embodiments, it should be understood that various changes, substitutions and alterations can be made herein without departing from the spirit and scope of the invention as defined by the appended claims. Although an embodiment of the invention may achieve multiple objectives, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A material bagging accelerator positionable between a material supplier and a bag form, fill, and seal machine to enable the bag machine to operate at a higher speed by filling bags with material more quickly, comprising:

a downward funneling chute with interior surfaces to prevent the material from scattering, the funneling chute comprising an arcuately-shaped upper portion shaped to track the trajectory of material received from an end of the material supplier passing through a first cross sectional area and to deliver the material through a second, smaller, cross sectional area to a bag of the bag machine, the funneling chute further comprising a substantially vertical lower portion; and an accelerating mechanism integrally disposed at sides of the lower portion of the funneling chute so that elements of the accelerating mechanism form interior surfaces of the funneling chute and do not substantially block the passage of material, to accelerate material passing through the funneling chute, wherein the material enters the funneling chute at a large cross section with low velocity and exits the funneling chute at a smaller cross section with higher velocity.

2. The accelerator of claim 1, wherein the accelerating mechanism comprises a plurality of rollers disposed on opposite sides of the lower portion to accelerate and pass material there through.

3. The accelerator of claim 1, wherein the accelerating mechanism comprises a threshing mechanism disposed on a side of the lower portion to accelerate and thresh material passing through the lower portion.

4. The accelerator of claim 1, wherein the accelerating mechanism comprises a conveyor belts disposed on opposite sides of the lower portion to accelerate material passing there through.

5. The accelerator of claim 4, wherein the conveyor belt is cleated.

6. A bagging system for bagging bulk material, comprising:

a material supplier to provide in succession a plurality of doses of the material;

a funneling chute with an arcuately shaped upper portion shaped to track a trajectory of material received from the material supplier passing through a first cross sectional area at the upper portion and to deliver the material through a lower portion of the chute through a second cross sectional area to a bag;

an accelerating mechanism to accelerate material passing through the funneling chute, the accelerating mechanism disposed at sides of the lower portion so that elements of the mechanism form interior surfaces of the chute and do not substantially block the passage of material, wherein the material enters the funneling chute at a large cross section with a first velocity and exits the funneling chute at a smaller cross section with higher velocity; and a bag supplier to provide in succession a plurality of bags to receive material from the funneling chute through the second cross sectional area.

7. The system of claim 6, wherein the material supplier comprises a leveler and can provide a dose of a specifiable volume.

8. The system of claim 6, wherein the accelerating mechanism comprises a conveyor belts disposed on opposite sides of the lower portion to accelerate material passing there through.

9. The system of claim 6, wherein the accelerating mechanism comprises a threshing mechanism to thresh material passing through the funneling chute.

10. The system of claim 9, wherein a threshing mechanism comprises a rotating blade.

11. The system of claim 9, wherein a threshing mechanism comprises interleaved discs.

12. The system of claim 6, wherein material passing through the funneling chute is accelerated so that the rate of material passing through the first cross sectional area is about the same as the rate of material passing through the second cross sectional area.

13. The system of claim 6, wherein the bag supplier comprises a roll of bag material to form bags there from.

14. A method for conveying material from a material source to a bag, comprising:

supplying material to a conveyor;

conveying material in doses to an input of a chute that has an arcuately shaped upper portion to receive and surround the material entering the chute and a lower vertical portion that tapers into a smaller cross sectional area;

accelerating the material through the chute from a first cross sectional area to a second smaller cross sectional area by an accelerator disposed at sides of the lower vertical portion to accelerate the material without blockage, the material being accelerated from the first cross sectional area at a first velocity to the second smaller cross sectional area at a second higher velocity; and receiving each dose into a bag in a succession of bags for receiving doses.

15. The method of claim 14, further comprising threshing the material passing through the chute.

16. The method of claim 14, further comprising chopping the material passing through the chute.

17. The method of claim 14, further comprising cutting into the material passing through the chute.

* * * * *